US005913468A

United States Patent [19]

Tsai et al.

[11] Patent Number: 5,913,468

[45] Date of Patent: Jun. 22, 1999

[54] MICRO-JOINT PART SEPARATOR

[75] Inventors: Roberto J. Tsai, Arcadia; Michael Beransky, Irvine; Can Q. Nguyen, Westminster; Jeffrey Burnell, Garden Grove, all of Calif.

[73] Assignee: Amada Engineering & Service, Inc., La Mirada, Calif.

[21] Appl. No.: 08/778,850

[22] Filed: Jan. 6, 1998

[51] Int. Cl.[6] ..... B26F 3/00

[52] U.S. Cl. ..... 225/103; 225/93; 83/27

[58] Field of Search ..... 225/103, 104, 225/105, 93; 83/27

[56] References Cited

U.S. PATENT DOCUMENTS

| | | | |
|---|---|---|---|
| 3,338,084 | 8/1967 | Stegman, Sr. . | |
| 3,464,104 | 9/1969 | Tonner et al. . | |
| 4,400,861 | 8/1983 | Parker . | |
| 4,509,355 | 4/1985 | Oishi | 225/103 |
| 4,546,683 | 10/1985 | Volkel et al. | 83/27 |
| 5,027,505 | 7/1991 | Nakamura et al. | 29/832 |
| 5,104,023 | 4/1992 | Nishiguchi et al. | 225/103 |
| 5,683,023 | 11/1997 | Seto | 225/103 |

*Primary Examiner*—M. Rachuba
*Attorney, Agent, or Firm*—Irving Keschner

[57] ABSTRACT

An improved method and device for separating parts from the sheet metal carrier. In particular, a single sheet from a stack of sheets having parts micro-joined to the carrier sheet is transported to the nip of a pair of pinch rollers. The pinch rollers move down to engage the front edge of the sheet, the pinch rollers moving the sheet to the nip formed between a pair of main rollers. The main rollers then move together to the drive position and transport the sheet to a separation device on the opposite side of the main rollers. The main rollers drive the sheet material in a manner such that the top surface of the leading edge of the sheet metal is engaged below the forward tip of the separation device. The separation device is then moves downwardly so that the upper surface of the separation device assembly is level to the part pass line. The main rollers continue to feed the sheet metal such that the remainder scrap, or skeleton, portion is driven in a downward direction and the parts separated by the process are transported in the forward direction where they are collected. The rollers are moved vertically in an oscillatory manner to relieve the stress in the sheet material. In a preferred embodiment, the separating device is wedge-shaped.

12 Claims, 8 Drawing Sheets

FIG. 4
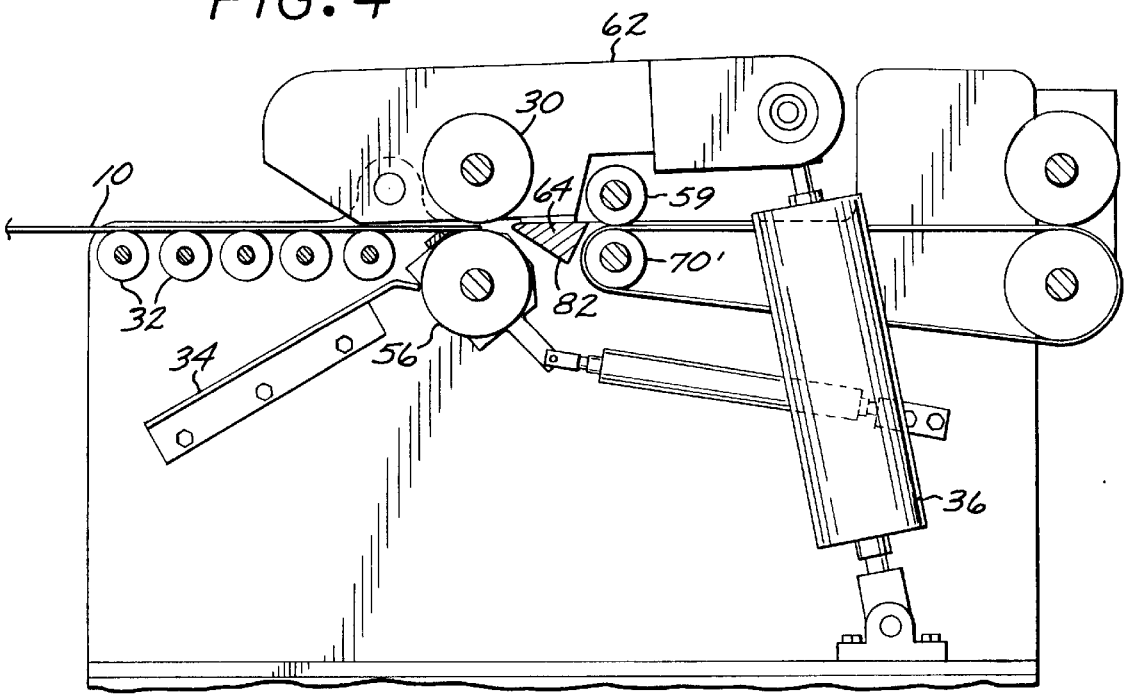
FIG. 5
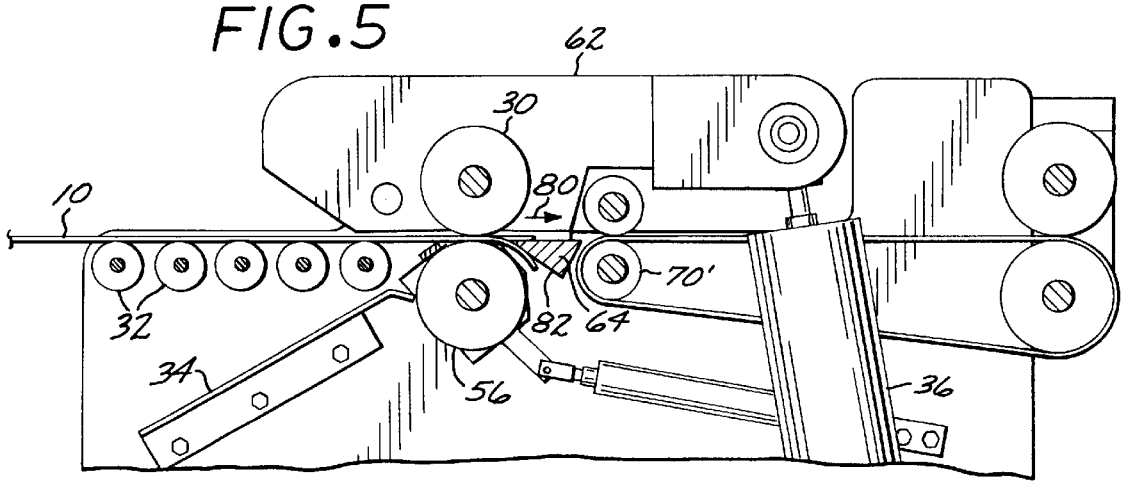
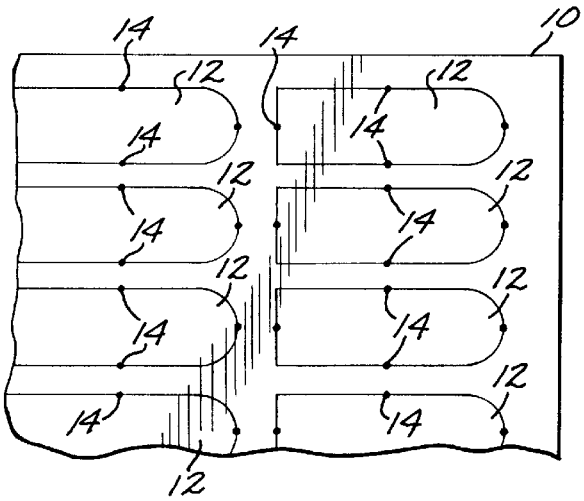
FIG. 1

MICRO-JOINT PART SEPARATOR

FIELD OF THE INVENTION

The present invention provides an improved system for removing parts from metal sheets, the system being automatic and efficient in operation.

BACKGROUND OF THE INVENTION

When forming sheet metal products, one or more parts are formed in a piece of sheet metal and are connected to the sheet metal through one or more micro-joints. In order to separate these parts, it is conventional that subsequent mechanical or manual hammering or vibrating must be carried out with respect to the sheet metal. In addition to potential damage such as cuts, bends, and depressions formed on the part, the conventional parts separation process is noisy and labor intensive, increasing the overall costs of fabricating sheet metal parts.

U.S. Pat. No. 5,284,043 to Hayashi describes a process for separating a part from a sheet of metal. In order to separate the part from the sheet while avoiding damage to the part, the sheet metal and the part contained therein must be specially prepared. In particular, the part must be first contoured while leaving a small joint such as a connecting web or micro-joint which connects the part to the sheet metal, and thereafter, a protrusion must be formed on or adjacent to the joint by lancing, embossing, or semi-shearing, the sheet metal then being transported to the pressing operation to press the protrusion in order to shear the micro-joint. The necessity of specially preparing the sheet metal and the part contained therein requires specially designed machinery to perform that task. This increases the overall production cost of each formed part. The parts separation process described in the background of the Hayashi patent is typical of that utilized in the sheet metal industry.

Other industries have utilized different techniques for separating a component joined to a carrier sheet. For example, U.S. Pat. No. 4,467,948 to Deslauriers discloses a machine for stripping waste from previously die-cut blanks; U.S. Pat. Nos. 4,033,240 and 4,467,940 to Deslauriers disclose a device for automatically removing waste material from die-cut blanks; U.S. Pat. No. 3,391,589 to Bishop also discloses an apparatus for cutting blanks from board and separating the scrap from the blanks; U.S. Pat. No. 4,561,334 to Sarka discloses a rotary cutting device that cut blanks from thin sheets of webs of material such as paper, paper board, cardboard, plastic film, metal foil, sheet metal and the like; and U.S. Pat. No. 4,109,842 to Acquilla discloses a device for automatically stripping waste material from sheeting such as precut cardboard, the device incorporating projections which interact with the waste portion of the sheeting enabling its removal.

Other than the Hayashi patent, the other prior art references noted above all deal with separating products from a sheet carrier, the carrier comprising material other than sheet metal.

Due to the nature of the sheet metal working process, separating devices which can be utilized in other industries, such as cartons, paper, etc., cannot be efficiently and effectively utilized. As noted in the Hayashi patent, the separation process is typically carried out by manual means, i.e. after the microjoints are formed, sheets are typically delivered to an area where workers either shake the sheet to cause the micro-joints to sever or use hammers or other mechanical components to do the separation.

The lack of an automatic apparatus for use in the sheet metal processing industry to separate parts from the carrier (scrap) material and the requirement to use manual labor to do so adds greatly to the cost of the overall sheet metal process.

What is thus desired is to provide an automatic process for separating parts micro-joined to the metal carrier material which can be easily incorporated in the conventional processing line and which reduces the cost associated with the separation process now utilized in the sheet metal industry.

SUMMARY OF THE PRESENT INVENTION

The present invention provides an improved method and apparatus for separating parts from the sheet metal carrier. In particular, a single carrier sheet from a stack of sheets having parts micro-joined to the carrier sheet is transported to the nip between upper and lower main pinch rollers. The main rollers then move to transport the sheet to a separation device on the opposite side of the main rollers. The main rollers drive the sheet material in a manner such that the top surface of the leading edge of the sheet metal is engaged below the forward tip of the separation device. The separation device is then moved downwardly so that the upper surface of the separation device assembly is level to the part pass line, the downward motion of the separating device breaking the micro-joints thus freeing the parts as the contact the edge of the separating device. The main rollers continue to feed the sheet metal such that the remainder scrap, or skeleton, portion is driven in a downward direction and the parts separated by the process are transported in the forward direction where they are collected. The upper roller is moved vertically in an oscillatory manner to relieve the stress in the sheet material. In a preferred embodiment, the separating device is wedge-shaped. The skelton is formed into a coil, the coiled skeleton thereafter being flattened for scrap and transportability purposes.

The present invention thus provides an automatic system for separating parts from a metal sheet which is easily adapted for use in currently available sheet bending apparatus. The automatic separation process eliminates the highly labor intensive techniques currently utilized in the sheet metal industry.

DESCRIPTION OF THE DRAWINGS

For a better understanding of the invention as well as other objects and further features thereof, references made to the following description which is to be read in conjunction with the accompanying drawings wherein;

FIG. 1 illustrates a sheet of metal having parts formed therein and joined together by micro-joints;

FIG. 4 is a view along line 4—4 of FIG. 2 showing the metal sheet prior to the initiation of the separation step;

FIG. 5 is similar to FIG. 4 but shows the apparatus after the separation step is initiated;

DETAILED DESCRIPTION OF THE INVENTION

Figure 2:
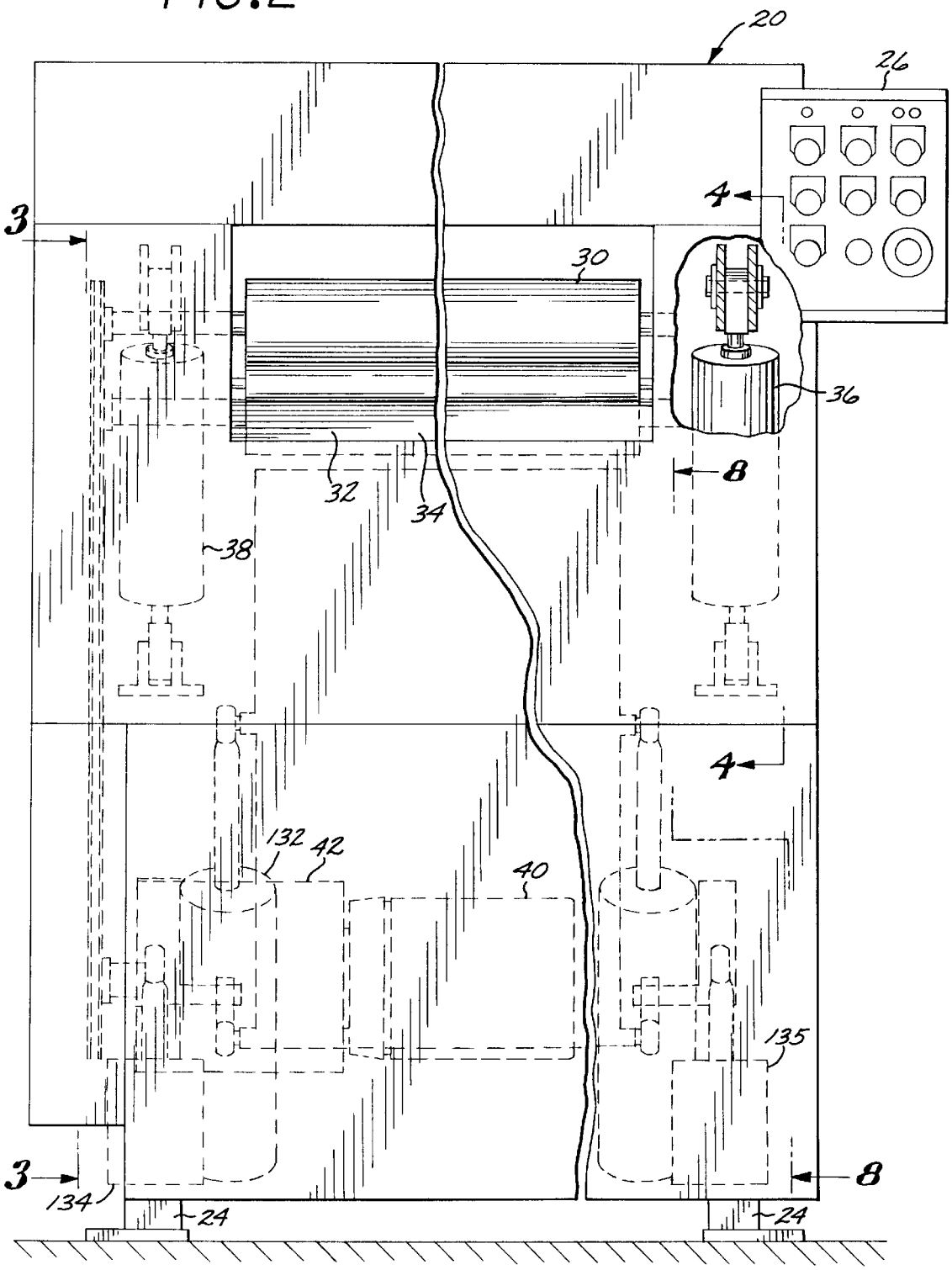
FIG. 2 is a front elevation view of the apparatus of the present invention.

FIG. 1 illustrates a conventional sheet of metal 10 comprising a plurality of parts 12 formed thereon. Although only four rows and two columns of parts 12 are illustrated, the arrangements of parts can vary. As is conventional in the sheet metal industry, each part 12 is joined to the remainder of the sheet, commonly known as scrap or the skeleton, by a series of micro-joints 14. Though four micro-joints 14 are shown for joining parts 12 to the remainder of the sheet 10, the number and placement of these micro-joints also can be varied. The use of micro-joints to temporarily secure parts 12 to the sheet 10 is a conventional process but forms no part of the present invention. At this point in the conventional metal sheet stamping process, the sheet 10 is removed and transported to an area where workers take the sheet and shake it in a manner such that the micro-joints would sever thus separating the parts 12 from the remainder of the sheet 10. This is a costly, labor intensive process and has resulted in the techniques of the present invention.

Referring now to FIG. 2, separation apparatus 20 of the present invention is illustrated. Apparatus 20 comprises housing 22 supported by four legs 24 (only two illustrated) and control panel 26, the latter enabling an operator to control the operation of the apparatus 20. An upper pinch roller 30, sheet supporting roller 32 (FIGS. 4 and 5), plate 34 (FIGS. 4–7), dual air cylinders 36 and 38, drive motor 40, main drive gear box 42 and crusher air cylinders 132, 133, 134 and 135 are illustrated to show their position within apparatus 20, the specific functions thereof to be described hereinafter.

Figure 3:
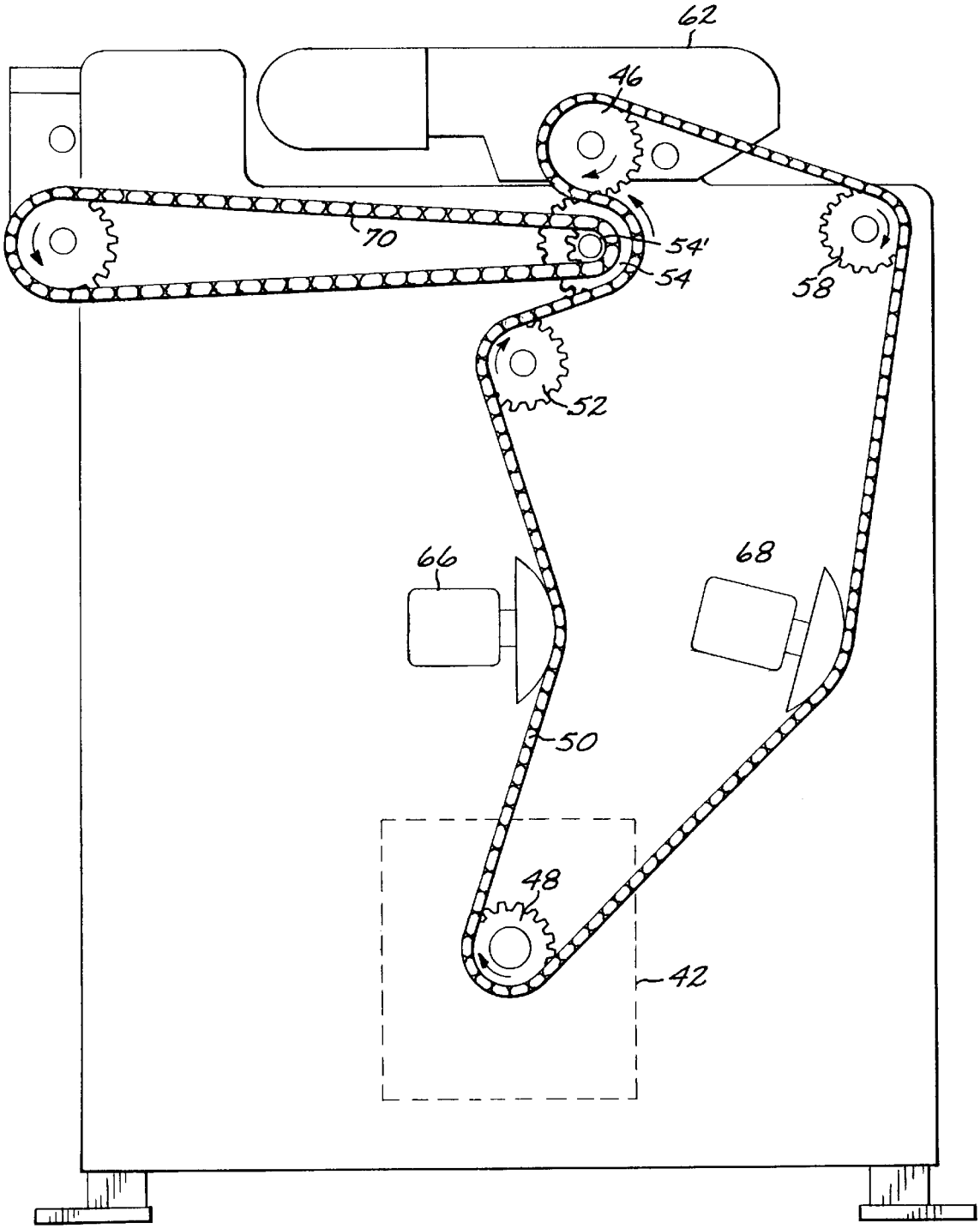
FIG. 3 is a simplified side view of the apparatus shown in FIG. 2 along line 3—3.

FIG. 3 is a simplified view of the internal drive mechanism of apparatus 20. Main drive gear reducer 42, through motor 40 (not shown), is utilized to drive the main drive sprocket 48 in a clockwise direction. Main drive chain 50 is mounted about the main drive sprocket 48, idle spocket 52 and sprocket 54 which drives lower pinch roller 56 (FIGS. 3 and 4), and a sprocket gear 46 which drives lower pinch roller 30 and idler spocket 58. Sprocket 54' is attached to spocket 54 as illustrated and drives chain 70. Chain 70 energizes the parts conveyor system to convey separated parts 12 away from apparatus 20. Air cylinders 36 and 38 are provided and, as will be described hereinafter, control the position of arm 62 and wedge device 64. Spring loaded devices 66 and 68 are utilized to tighten chain 50.

Figure 6:
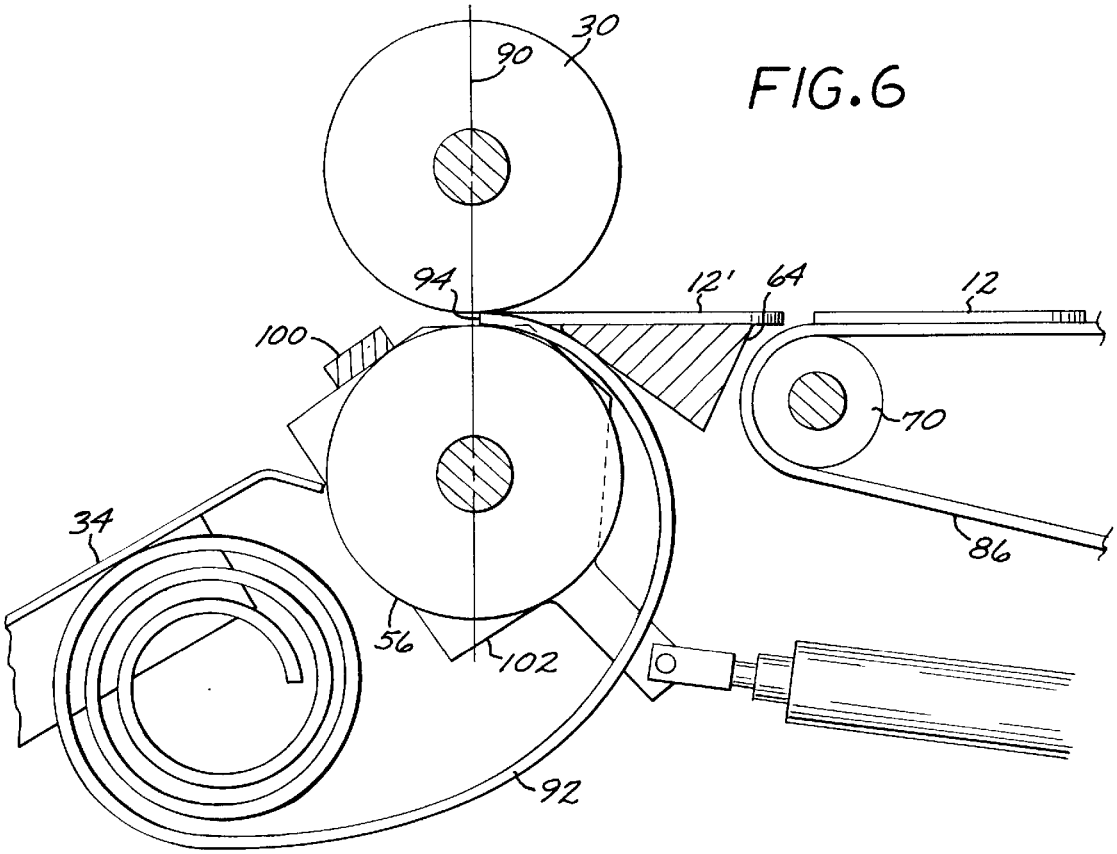
FIG. 6 illustrates the beginning of the separation of the last part from the metal sheet.

In operation, when metal sheet 10 reaches surface 82 of wedge device 64, the air cylinders 36 and 38 are activated, the arm 62 containing the upper roller 30 moving towards the fixed lower pinch roller 56 thus engaging sheet 10 between the two rollers. At the same time, motor 40 is energized causing the main drive chain 50 to move about drive sprocket 48 in a clockwise direction (FIG. 3). The movement of chain drive 50 also causes the upper and lower pinch rollers 30 and 56, respectively, to rotate, driving the sheet metal 10 such that surface 82 of wedge device 64 forces skeleton 92 to go below wedge device 64, while parts 12 continue to travel horizontally across the top of wedge device 64 (FIG. 6). The system controller (designed to provide the input/output functions necessary for apparatus 20 to perform its operational functions, such as power on, standby position of arm 62, etc. The controller is of conventional design and is not considered a part of the claimed invention) sends timing signals to the air cylinder solenoids, switching the solenoids on and off enabling the air cylinders 36 and 38 with roller 30 thereon to move up and down in an oscillatory manner. This motion relieves stress on metal sheet 10 caused by the crowned shaped rollers 30 and 56. At the same time, sheet 10 is continuously driven in the direction of arrow 80, the downward force provided by the wedge device 64 and the forward movement of the sheet combining to sever the micro-joints 14 holding the parts 12 to the carrier sheet 10 as the sheet 10 continues to move in the direction of arrow 80. Referring to FIG. 1, the first column of parts 12 operated on by wedge device 64 causes the micro-joints 14 to sever in sequence as the sheet is continued to be driven. A driven roller 59 in contact with the conveyor belt and pressing on roller 70' provides a pulling force to draw parts 12 from wedge 64 onto the conveyor belt. After the first column of parts are separated, the following columns are in turn separated. The skeleton, or remainder of the sheet, 92 is driven downward by the surface 82 of wedge device 64 in a manner such that the skeleton is wound as a coil under plate 34 as shown in FIG. 6. The separated parts are transported by conveyor belt 86 to a stacking area (not shown). A trailing edge sensor (not shown), senses when the trailing edge of a sheet being operated on exits the nip of pinch rollers 30 and 56 and sends a signal to the air cylinder 36 causing upper pinch roller 30 to be moved away from lower pinch 56 roller and wedge device 64 to be raised to its initial operating position.

Figure 7:
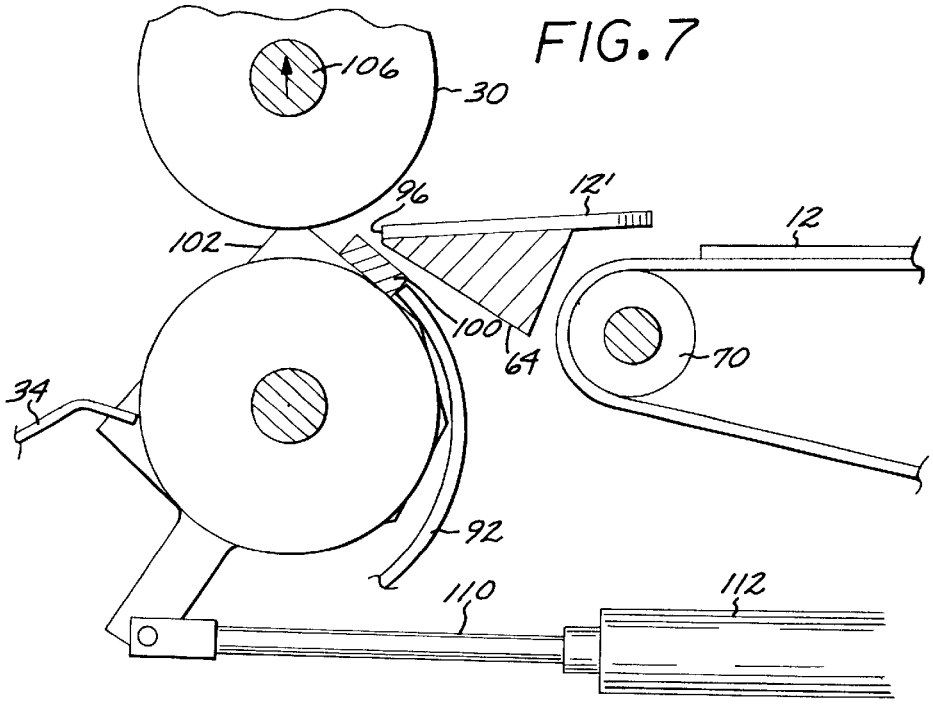
FIG. 7 illustrates the mechanism used to separate the last part from the metal sheet.

FIG. 6 illustrates the situation when the last separated part 12 has passed centerline 90 of rollers 30 and 56. At this point, skeleton 92 (remainder of sheet 10 after parts 12 have been removed) has been coiled under plate 34 and part 12' rests on the upper surface of wedge shaped device 64. The driving nip thus no longer engages the trailing edge 94 of skeleton 92 or the trailing edge 96 of part 12 (although only one part is referred to, in actuality an entire column of parts are operated on at the same time). In order to remove the skeleton from apparatus 10, a lengthwise extending bar, or pusher, member 100 mounted on pivotable support device 102, is moved to engage end 94 of skeleton 92. In particular, and as shown in FIG. 7, arm 62 is moved at the same time in the vertical direction as indicated by reference arrow 106 by cylinder 36, thus moving upper roller 30 and attached wedge member 64 in the same direction, providing enough room for bar member 100 to pass through the nip to force the skeleton into the storage area under plate member 34. The position of support device 102 is controlled by reciprocating arm 110 of air cylinder 112. As shown in FIG. 7, arm 110 is in its extended, or operative position, which moves support device 102 in the clockwise direction, in turn moving bar 100 in the same direction as illustrated. The degree of movement is sufficient to remove the skeleton 92 from lower roller 56. After the skeleton 92 is removed, air cylinder 112 is deenergized, moving bar member to the position shown in FIG. 6. Arm 62 is then moved in the downward direction (opposite to arrow 106) and the last parts 12 are transported to the part receiving area.

It should be noted that device 64 is preferably wedge shaped although other shaped devices can be used, the only requirement being that the sheet contacting surface be tapered, allowing parts 12 to be separated.

Figure 8:
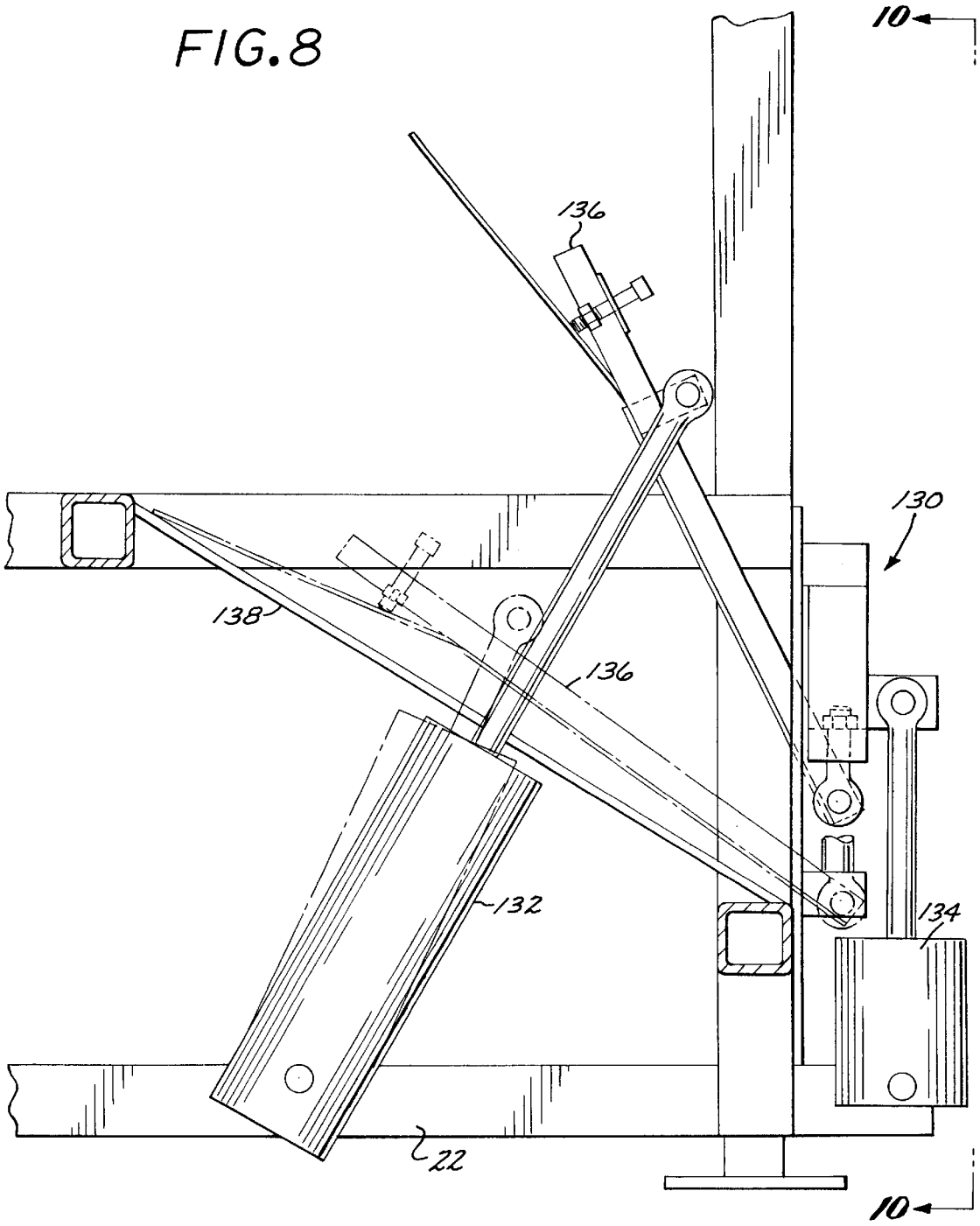
FIG. 8 is a side elevation view along line 8—8 of FIG. 2.
Figure 9:
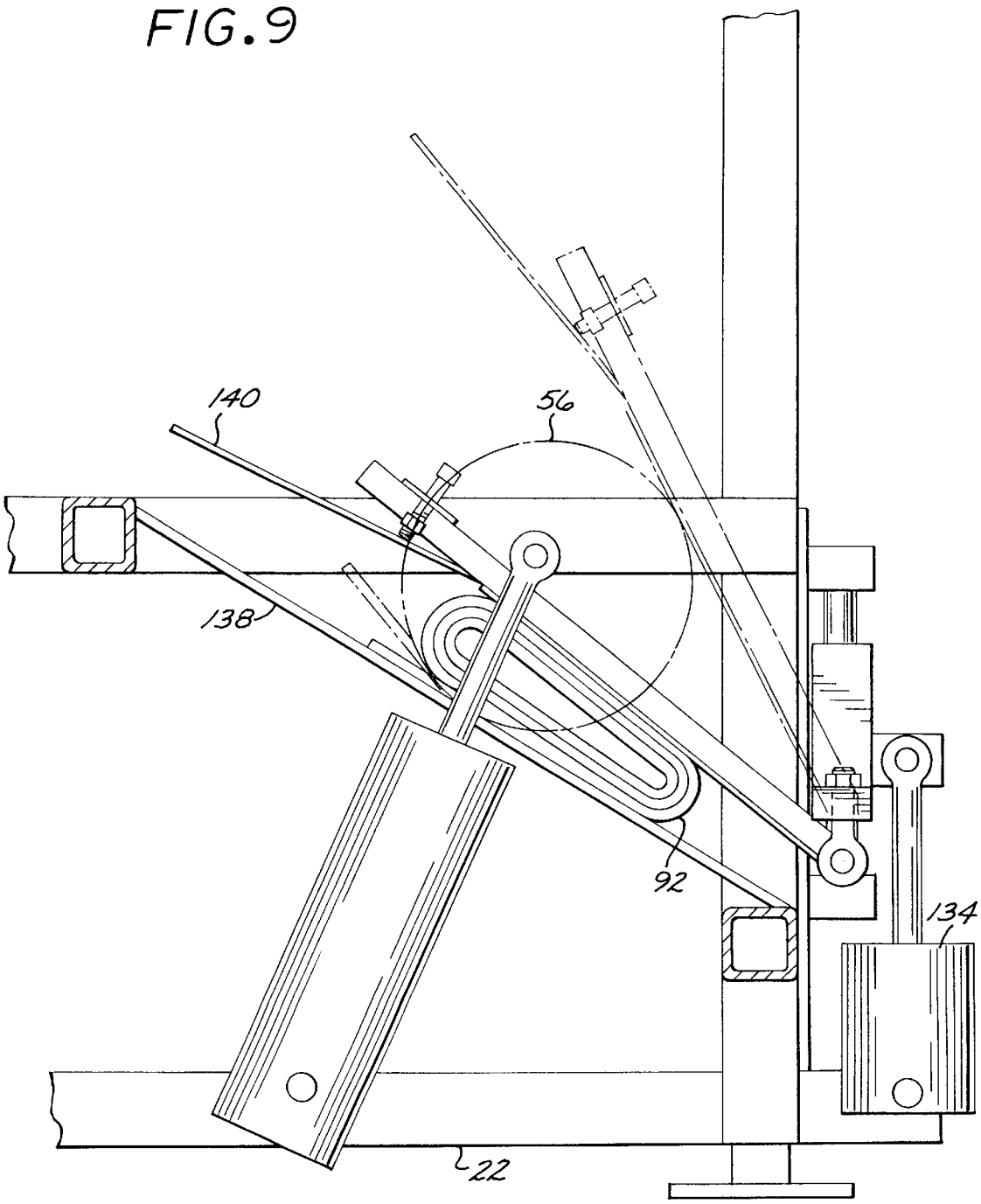
FIG. 9 is similar to FIG. 8 but shows the skeleton in the process of being flattened.
Figure 10:
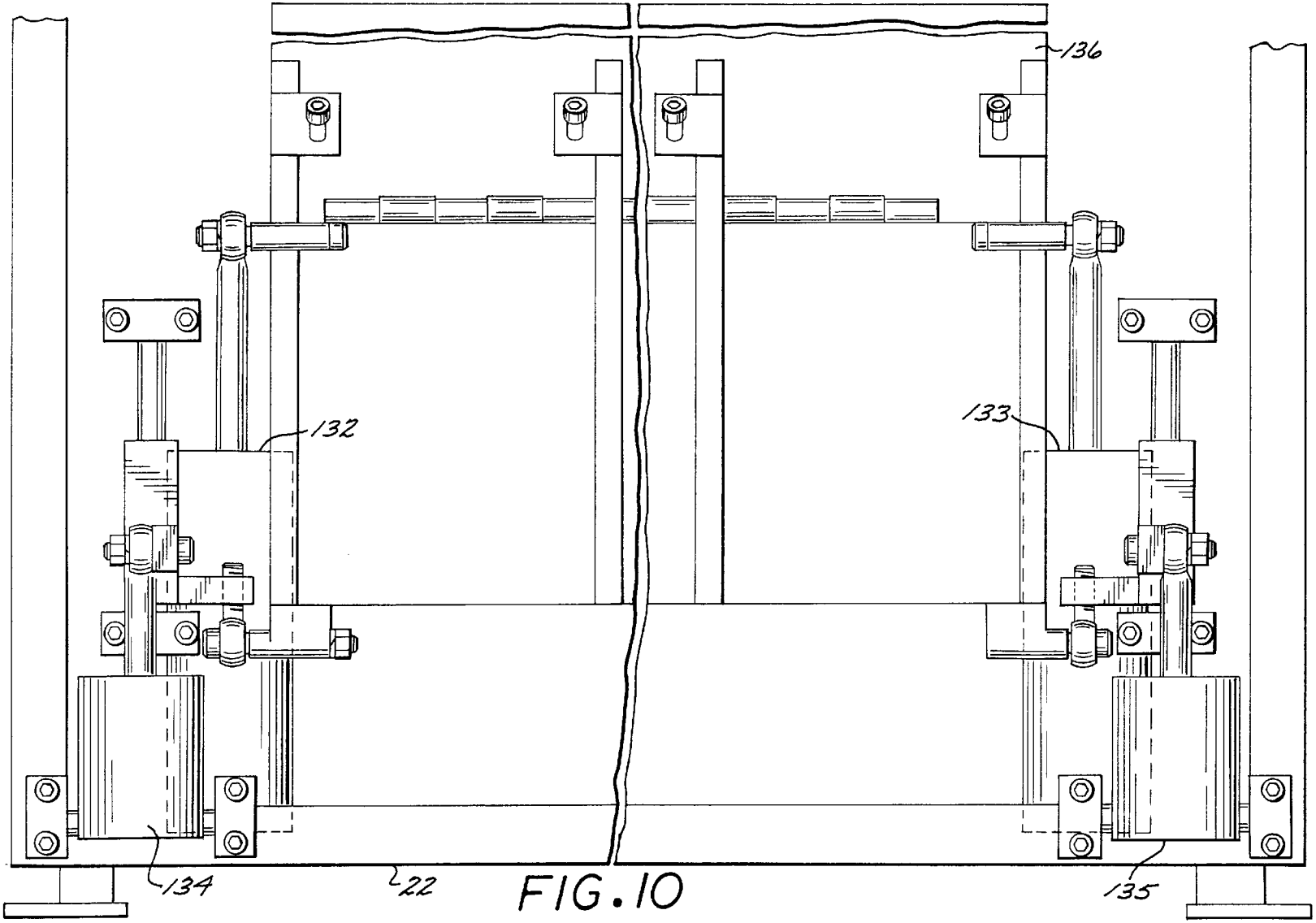
FIG. 10 is a view along line 10—10 of FIG. 8.

Referring now to FIGS. 8–10, a device 130 is provided as part of apparatus 20 to flatten (crush) skelton 92 after the parts 12 are removed from material sheet 10. In particular, two pair of cylinders 132 and 133 and 134 and 135 are mounted to housing 22. Air cylinders 132 and 133 have a short operating stroke; cylinders 134 and 135 have a longer operating stroke. A plate 136 is pivotably connected to each of the four air cylinders 132, 133, 134, and 135, the cylinder arms moving plate 136 between the open (upper) and closed positions as shown in FIGS. 8 and 9 (the open position is shown in phantom). When the skelton 92 is removed from lower roller 56, it drops between stationary plate 138 and movable plate 136 when the latter is in the open position. The air cylinders are then moved simultaneously downwardly, compressing or crushing skelton 92. Extension 140 on plate 136 prevents skelton 92 from sliding backwards. After the cylinder arms are retracted for the crushing operation, a sensor (not shown) is energized reversing the current to the cylinder solenoids. This in turn reverses the direction of movement of the cylinder arms causing plate 136 to move to the upper position enabling the flattened skelton to slide to the back of apparatus 20.

Figure 11:
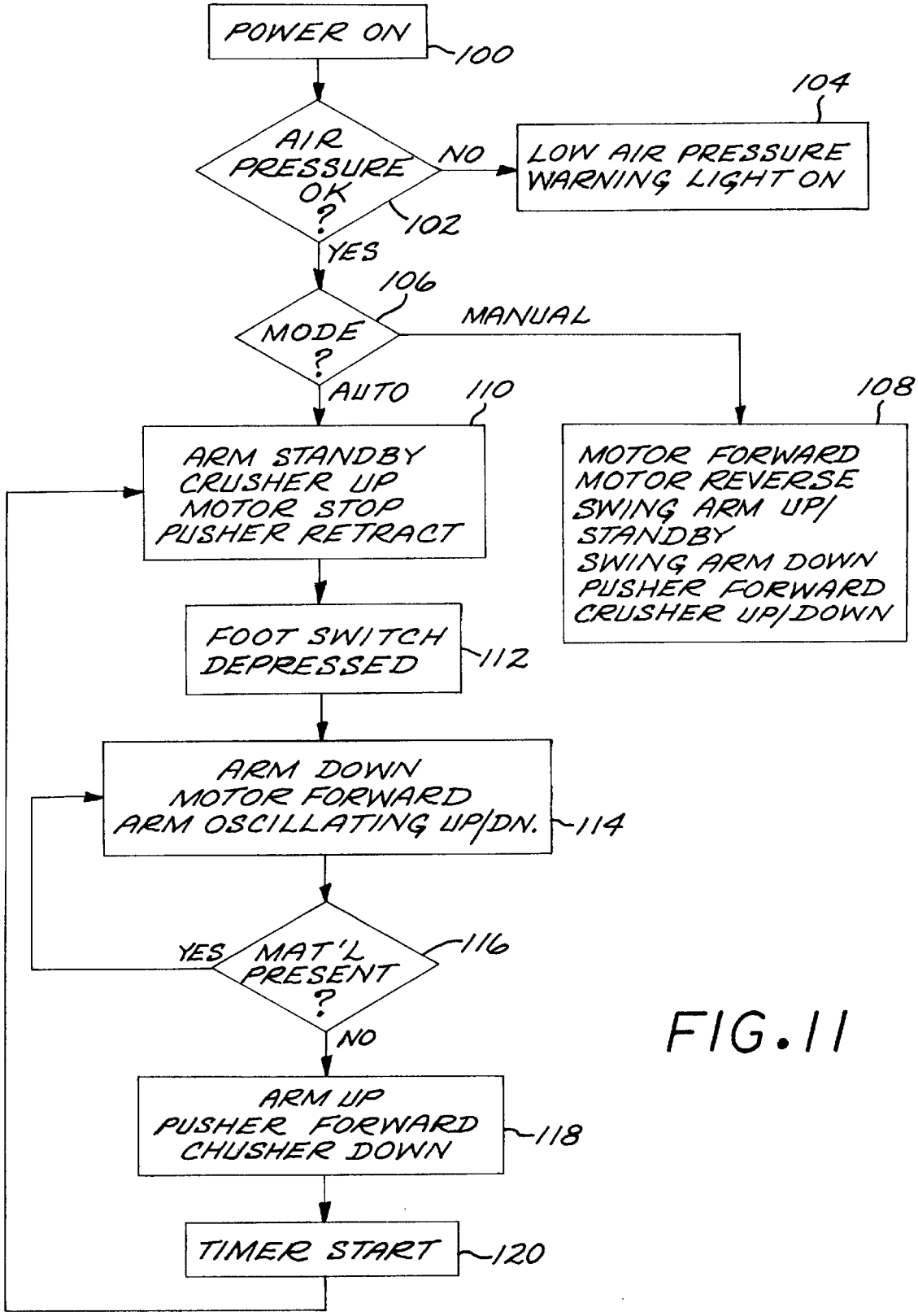
FIG. 11 is a flow diagram illustrating the apparatus operation sequence.

FIG. 11 is a flow chart illustrating the operation of the apparatus of the present invention.

The operator first presses the power on switch on panel 26 (step 150) and then ascertains whether proper air pressure is being supplied to the air cylinders (step 152). If not, the low pressure warning light (step 154) on panel 26 is turned on and the operator is required to take corrective action. If the air pressure is normal, the machine operator can select (step 156) either the manual mode of operation (step 158) or the automatic mode of operation (step 160) by energizing the correct switch on panel 26. In the manual mode, the operator can control the direction of motor 40 (foward or reverse), the position of swing arm 62 (up, down or standby), energize the pusher portion of apparatus 20 and determine whether the crusher is in the up or down position.

In the automatic mode, the swing arm 62 is initialized to the standby position, the crusher plate 136 is in the open position, the drive motor 40 unenergized and the pusher 100 retracted. A foot switch is then depressed (step 162) causing swing arm 62 to move downward, motor 40 to be in the foward operating position and arm 62 then to be in the oscillatory motion mode of operation (step 164). A sensor then determines if material is present (step 166); if present, the operations noted in step 164 are continued; if material is not present, arm 62 is raised, the pusher 100 moved foward, and the skelton crusher moved to its operating position (step 168). The system timer is then started (step 170) and the apparatus 20 is returned to its initial, or stand by position, awaiting the insertion of a new sheet of material.

While the invention has been described with reference to its preferred embodiment, it will be understood by those skilled in the art and where changes may be made and equivalence may be substituted for elements thereof without departing from the true spirit and scope of the invention. In addition, many modifications may be made to adapt to a particular situation or material to the teaching of the invention without departing from its essential teachings.

What is claimed is:

1. Apparatus for separating a part from a metal sheet, the part being joined to the metal sheet by at least one micro-joint comprising:

a movable member having a forward tapered portion and first and second surfaces;

means for feeding said metal sheet so that the leading edge thereof is in contact with said first surface of said movable member below said forward tapered portion; and means for moving said movable member in a downward direction, the second surface thereof being positioned below the surface of said metal sheet; said feeding means continuing to feed said metal sheet whereby said part is separated from said metal sheet.

2. The apparatus as defined in claim 1 wherein said separated part travels over said first surface of said movable member to a first location and the remainder of said metal sheet is directed by the second surface of said movable member to a second location.

3. The apparatus of claim 1 wherein said feeding means comprises first and second rollers.

4. The apparatus of claim 3 wherein said first roller is moved vertically in an oscillatory manner.

5. The apparatus of claim 1 wherein said movable member has a wedge shape.

6. The apparatus of claim 4 including means for controlling the oscillatory movement of said first roller means.

7. The apparatus of claim 1 wherein said metal sheet comprises a plurality of parts each joined to said sheet by at least one micro-joint.

8. The apparatus of claim 7 wherein a plurality of parts are aligned along the width of said metal sheet, the width of said moving means extending at least along the width of said metal sheet.

9. The apparatus of claim 2 further including means for moving said metal sheet remainder to said second location.

10. The apparatus of claim 5 including first means for detecting the position of the trailing edge of said metal sheet.

11. The apparatus of claim 1 further including means for pushing the last part in said metal sheet after said part is no longer moved by said feeding means.

12. The apparatus of claim 2 further including means for flattening said remainder sheet metal at said second location.

* * * * *